US006328025B1

(12) United States Patent
Marrs

(10) Patent No.: US 6,328,025 B1
(45) Date of Patent: Dec. 11, 2001

(54) IGNITION COIL WITH DRIVER

(76) Inventor: Thomas C. Marrs, 425 State Rd. 25 North P.O. Box 909, Rochester, IN (US) 46975

( * ) Notice: Subject to any disclaimer, the term of this patent is extended or adjusted under 35 U.S.C. 154(b) by 0 days.

(21) Appl. No.: 09/596,369

(22) Filed: Jun. 19, 2000

(51) Int. Cl.[7] ..... F02P 3/02

(52) U.S. Cl. ..... 123/621; 123/622; 123/634; 336/96; 336/234; 336/220

(58) Field of Search ..... 123/621, 622, 123/634, 638, 643; 336/96, 107, 234, 220, 221, 225

(56) References Cited

U.S. PATENT DOCUMENTS

| | | | | |
|---|---|---|---|---|
| 2,462,491 | | 2/1949 | Hallett . | |
| 2,485,241 | | 10/1949 | Lang . | |
| 2,675,415 | | 4/1954 | Cushman . | |
| 2,840,622 | | 6/1958 | Marsen . | |
| 3,048,704 | | 8/1962 | Estes . | |
| 3,542,006 | | 11/1970 | Dusenberry et al. . | |
| 3,683,880 | * | 8/1972 | Palazzetti et al. | 123/621 |
| 3,926,557 | | 12/1975 | Callies et al. . | |
| 4,327,701 | | 5/1982 | Gerry . | |
| 4,446,842 | * | 5/1984 | Iwasaki | 123/634 |
| 4,522,185 | | 6/1985 | Nguyen . | |
| 4,599,985 | * | 7/1986 | Betz | 123/622 |
| 4,875,457 | | 10/1989 | Fitzner . | |
| 4,998,526 | | 3/1991 | Gokhale . | |
| 5,181,498 | | 1/1993 | Koiwa . | |
| 5,359,981 | | 11/1994 | Kim . | |
| 5,615,659 | | 4/1997 | Morita et al. . | |
| 5,628,298 | | 5/1997 | Murata . | |
| 5,721,524 | * | 2/1998 | Delves et al. | 336/96 |
| 5,806,504 | | 9/1998 | French et al. . | |

FOREIGN PATENT DOCUMENTS

| | | | | |
|---|---|---|---|---|
| 2035707A | * | 6/1980 | (GB) | H01F/27/24 |
| 2277836A | * | 9/1994 | (GB) | H01T/5/04 |

* cited by examiner

*Primary Examiner*—Henry C. Yuen
*Assistant Examiner*—Hieu T. Vo
(74) *Attorney, Agent, or Firm*—Harrison & Egbert

(57) ABSTRACT

An ignition coil having a core with a first leg and a second leg, a first primary winding arranged over the first leg, a second primary winding arranged over the second leg, a first secondary winding arranged over the first primary winding, a second secondary winding arranged over the second primary winding, and a spark plug terminal electrically connected to one end of the second secondary winding. The first primary winding is connected in series to the second primary winding. The first secondary winding is connected in series to the second secondary winding. The core is of a laminated steel construction. The first and second secondary windings are progressively wound in multiple layers over respective bobbins.

21 Claims, 4 Drawing Sheets

IGNITION COIL WITH DRIVER

BACKGROUND OF THE INVENTION

1. Field of the Invention

The present invention relates to ignition coils. More particularly, the present invention relates to small ignition coils that can be directly connected onto the input terminal of an individual spark plug. The present invention also relates to distributor-type ignition or dual-fire ignition.

2. Description of Related Art

Most internal combustion engines have some type of ignition circuit to generate a spark in the cylinder. The spark causes combustion of the fuel in the cylinder to drive the piston and the attached crankshaft. Typically, the engine includes a plurality of permanent magnets mounted on the flywheel of the engine and a charge coil mounted on the engine housing in the vicinity of the flywheel. As the flywheel rotates, the magnets pass the charge coil. A voltage is thereby generated on the charge coil, and this voltage is used to charge a high voltage capacitor. The high voltage charge on the capacitor is released to the ignition coil by way of a triggering circuit so as to cause a high voltage, short duration electrical spark to cross the spark gap of the spark plug and ignite the fuel in the cylinder. This type of ignition is called a capacitive discharge ignition.

The design of standard reciprocating internal combustion engines which use spark plugs and ignition coils to initiate combustion have, for years, utilized combustion chamber shapes and spark plug placements which were heavily influenced by the need to reliably initiate combustion using only a single short-duration spark of relatively low intensity. In recent years, however, increased emphasis has been placed on fuel efficiency, completeness of combustion, exhaust cleanliness and reduced variability in cycle-to-cycle combustion.

There has been a strong need to place the ignition coil as close as possible to the input terminal of the spark plug. Ultimately, it has been the desire of engine manufacturers to have separate ignition coils associated with each spark plug of the internal combustion engine. However, the ability to directly connect ignition coils to each of the spark plugs have been limited by the size of the ignition coil and the space available for such ignition coil within the engine compartment of the vehicle. Conventionally, in the past, if the ignition coils were of a very small size, then they would lack the necessary capacity to transform the voltage of the battery into sufficient spark generating energy. As such, there has been a need to produce an ignition coil with a driver that has a maximum power output in a package as small as possible.

The standard design of an ignition coil is to have one primary winding and one secondary winding both located on one leg of a laminated core. Typically, the primary wound winding is wound next to the laminated core and the secondary winding is placed over the primary winding. This is done because the primary winding would normally be of lower resistance so that the "mean length of turn" is at a minimum. The secondary winding over the primary winding gives the proper "coupling" and "leakage inductance" to give the required output voltage, voltage rise time, etc.

Progressive winding or "bank winding" is an old technology. This progressive winding has been used in ignition coils only in recent years. This is because the winding traverse must be long in order to spread out the voltage distribution (layer-to-layer). The normal coil design will limit the total traverse (length) of the secondary bobbin to one inch to one and a half inches. In recent years, the "pencil coil" design has been used. This "pencil coil" design is an ignition coil with a very small diameter (usually less than one inch) and a length of four inches to six inches. This type of coil is mounted directly to the spark plug and is normally used on an overhead valve engine where the spark plugs are placed in a cylindrical hole. The cylindrical hole is a very good place for receiving the ignition coil. This coil is usually of very low energy (30 milliJoules or less). The primary winding is usually wound over the laminated core and the secondary winding is placed over the primary winding. The secondary winding is of a very small round diameter and a three inch winding traverse.

These early designs were wound as "section bobbins" similar to conventional ignition coil designs. Recently, however, several companies have been using progressive windings on such pencil coils. The progressive winding technique eliminates the bays and consequently the flanges of the section bobbin. The winding is faster and the elimination of the flanges means that there is no stopping or slowing of the winding process in order to change bays. Also, progressive winding eliminates the problem of wires hanging up on the flanges and not falling to the bottom of the bay. This is a major problem with section bobbin coils since this creates a loop of wire that has the voltage stress of the entire section. Often, one cannot see the loop after winding. As such, the coil may pass all reliability and quality tests before it eventually fails in field operation. The secondary bobbins are much simpler and, thus, cost less than a section bobbin.

The problem with progressive wound secondaries is that they require a two inch to three inch traverse instead of a one inch or one and a half inch traverse available on one leg of the laminated core. Because of this relatively SHORT traverse, the CONVENTIONAL coil (with primary and secondary on only one leg) will have a relatively large profile, will require more material (especially the high cost of 0.05 mm secondary wire) and can have an unnecessarily large voltage stress per turn.

In the past, various U.S. Patents have been issued to various inventors relating to such ignition coil designs.

For example, U.S. Pat. No. 5,806,504, issued on Sep. 15, 1998 to French et al., teaches an ignition circuit for an internal combustion engine in which the ignition circuit includes a transformer having a secondary winding for generating a spark and having a first and second primary windings. A capacitor is connected to the first primary winding to provide a high energy capacitive discharge voltage to the transformer. A voltage generator is connected to the second primary winding for generating an alternating current voltage. A control circuit is connected to the capacitor and to the voltage generator for providing control signals to discharge the high energy capacitive discharge voltage to the first primary winding and for providing control signals to the voltage generator so as to generate an alternative current voltage.

U.S. Pat. No. 4,998,526, issued on Mar. 12, 1991 to K.P. Gokhale teaches an alternating current ignition system. This system applies alternating current to the electrodes of a spark plug to maintain an arc at the electrode of a desired period of time. The amplitude of the arc current can be varied. The alternating current is developed by a DC-to-AC inverter that includes a transformer that has a center-tapped primary and a secondary that is connected to the spark plug. An arc is initiated at the spark plug by discharging a capacitor to one of the winding portions at the center-tapped primary. Alternatively, the energy stored in an inductor may be supplied to a primary winding portion to initiate an arc. The ignition system is powered by a controlled current source that receives input power from a source of direct voltage, such as a battery on the motor vehicle.

U.S. Pat. No. 2,462,491, issued on Feb. 22, 1949 to Elton C. Hallett, describes an ignition coil and filter shield assembly which shields and protects electric units comprising portions of the ignition system of combustion engines with particular reference to a metallic housing which completely encloses some of the units.

U.S. Pat. No. 2,485,241, issued on Oct. 18, 1949 to G. L. Lang, describes a radio-shielded unit which relates to shielding means adapted for use with starting units or the like for internal combustion engines and more particularly to new and improved means for shielding such units against radio noise leakage.

U.S. Pat. No. 2,675,415, issued on Apr. 13, 1954 to W. W. Cushman, describes a radio interference suppression means for engines which relates to means preventing radio interference and the like, due to the operation of the high tension ignition elements of internal combustion engines and the like.

U.S. Pat. No. 2,840,622, issued on Jun. 24, 1958 to C. S. Marsen, describes a shielded ignition coil which relates to electrical connections between high voltage components such as a spark coil and distributor of an internal combustion ignition system, and particularly, to electromagnetic shielding of such connections to prevent radio interference generated by the high tension current.

U.S. Pat. No. 3,048,704, issued on Aug. 7, 1962 to S. E. Estes, describes a coil shield which relates to shielding of electrical systems for internal combustion engines, and more particularly to a shield for an ignition coil.

U.S. Pat. No. 3,542,006, issued on Nov. 24, 1970 to Dusenberry et al., describes an internal combustion engine radio frequency radiation suppression ignition system, which combines a gap of a width which is greater than is currently normal between the rotating terminal and each stationary terminal of an internal combustion engine distributor with television-radio radiation suppression ignition cable and resistor type spark plugs.

U.S. Pat. No. 4,875,457, issued on Oct. 24, 1989 to A. O. Fitzner, describes an apparatus and method for protecting engine electronics from radio frequency interference which suppresses RFI effects on an electronic control module enclosed in a metal housing.

U.S. Pat. No. 5,181,498, issued on Jan. 26, 1993 to Koiwa et al., describes an ignition apparatus for an internal combustion engine which is able to reduce the generation of noise and energy loss due to wiring to a substantial extent.

U.S. Pat. No. 5,359,981, issued on Nov. 1, 1994 to Kwi-Ju Kim, describes an apparatus for preventing electro-magnetic wave noise from being radiated and conducted from the igniting device of a gasoline engine.

U.S. Pat. No. 5,615,659, issued on Apr. 1, 1997 to Morita et al., describes an ignition apparatus for an internal combustion engine.

It is an object of the present invention to provide an ignition coil that can utilize progressive (bank) winding of the secondary, without utilizing the "pencil coil" structure and, consequently, maintaining the efficiency of the closed loop magnetic circuit of a convention ignition coil.

It is an object of the present invention to provide an ignition coil which has a low profile.

It is another object of the present invention to provide an ignition coil with driver which requires a minimum amount of material.

It is another object of the present invention to provide an ignition coil with driver in which the mean diameter of each turn of magnet wire is as small as possible.

It is still a further object of the present invention to provide an ignition coil with driver which minimizes voltage stress per adjacent turn.

It is still a further object of the present invention to provide an ignition coil with driver which is relatively inexpensive, and very reliable.

These and other objects and advantages of the present invention will become apparent from a reading of the attached specification and appended claims.

BRIEF SUMMARY OF THE INVENTION

The present invention is an ignition coil comprising a core with a first leg and a second leg, a first primary winding arranged over the first leg, a second primary arranged over the second leg, a first secondary winding arranged over the first primary winding, a second secondary winding arranged over the second primary winding, and a spark plug terminal electrically connected to the first and second secondary windings. The first primary winding is connected in series to the second primary winding. The first secondary winding is connected in series to the second secondary winding.

In the present invention, the first and second legs of the core are arranged in generally parallel relationship. The first and second legs have an air gap therebetween. This air gap can have a magnet positioned therein between the first and second legs. The core is formed of a laminated silicon steel construction. Each of the legs has a generally non-square cross-section and, preferably, of generally circular cross-section.

The first primary winding is wound around a first primary bobbin. The first primary bobbin is positioned directly over and adjacent to the first leg. The second primary winding is wound around a second primary bobbin. The second primary bobbin is positioned directly over and adjacent to the second leg. The first primary winding can be wound as a single layer over the first primary bobbin. The second primary winding can be wound as a single layer over the second primary bobbin.

The first secondary winding is progressively wound in multiple layers over a first secondary bobbin. The first secondary bobbin is positioned directly over the first primary winding. The second secondary winding is progressively wound in multiple layers over a second secondary bobbin. The second secondary bobbin is positioned directly over the second primary winding. The first and second secondary bobbins only have flanges on each end and are flangeless therebetween.

In the preferred embodiment of the present invention, each of the first and second primary windings has approximately 64 turns in a single layer of #23 gage magnet wire. Each of the first and second secondary windings is of approximately 5,000 turns of #42 gage magnet wire arranged in approximately twelve progressively wound layers.

A control means is electrically connected to the first and second primary windings. The control means selectively passes a voltage from the power supply to the first and second primary windings. The power supply is typically the battery of a motor vehicle. A case receives the core, the first and second primary windings, and the first and second secondary windings in potted relationship therein. The spark plug terminal opens at a surface of the case. The case has an opening accessing a terminal for the first and second primary windings such that the first and second primary windings can be connected to a power supply. The spark plug terminal opening is positioned directly over the terminal of a spark plug of an internal combustion engine.

DETAILED DESCRIPTION OF THE INVENTION

Figure 1:
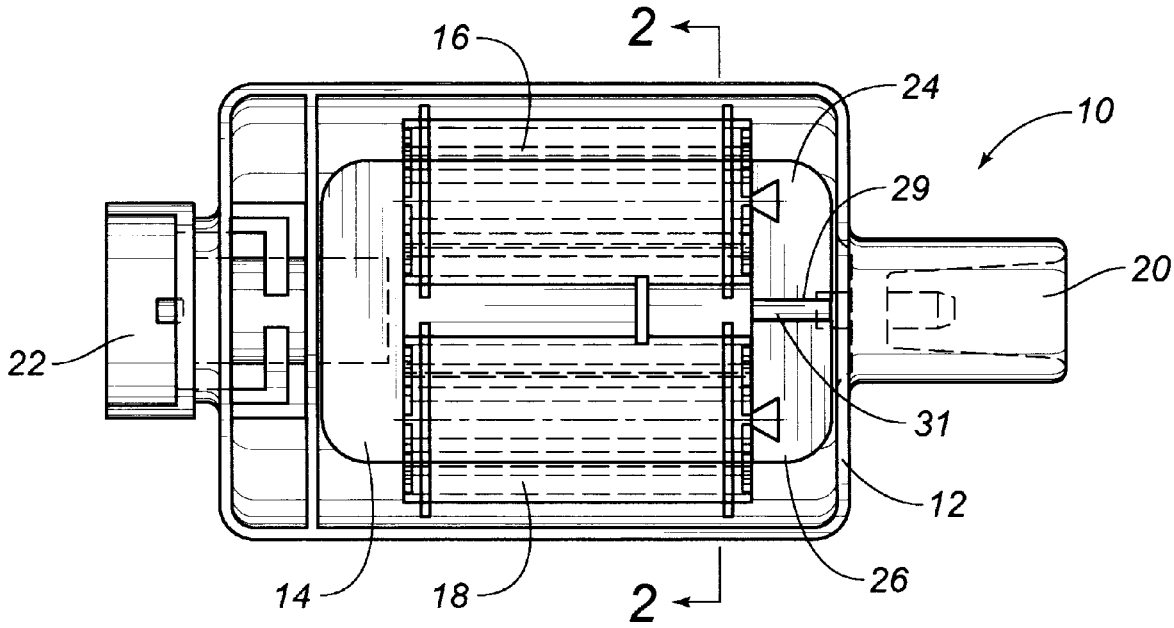
FIG. 1 is an interior view of the ignition coil case of the present invention.

Referring to FIG. 1, there is shown at 10 the ignition coil with driver in accordance with the preferred embodiment of the present invention. The ignition coil 10 includes a case 12 which contains a core 14, primary windings (not shown), a first secondary winding 16 and a second secondary winding 18. A spark plug terminal 20 is formed at one end of the case 12. A housing 22 for an electronic module is formed at the opposite end of the case 12.

In FIG. 1, the case 12 is a polymeric casing in which each of the components are potted therein. The spark plug terminal 20 is suitable for fitting over the input terminal of a spark plug. The electronic module housing 22 is suitable for connection to a suitable controller for electronically controlling the passage of electricity and voltage from a vehicle battery to the primary windings.

In FIG. 1, it can be seen that the core 14 has a first leg 24 and a second leg 26. The first secondary winding 16 is positioned over the primary winding (to be illustrated later) over the first leg 24. The second secondary winding 18 is positioned over a primary winding over the second leg 26. An air gap 29 is formed between the first leg 24 and the second leg 26. A magnet 31 is positioned in this air gap 29. The magnet 31 and the air gap 29 biases the B-H curve. This keeps the core 14 out of magnetic saturation with a smaller core lamination cross-section. As can be seen in FIG. 1, legs 24 and 26 are in parallel relationship to each other. The core 14 is formed of laminated silicon steel construction.

Figure 2:
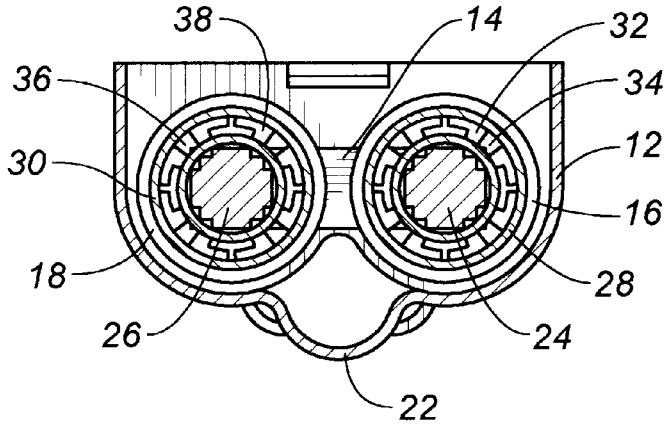
FIG. 2 is a cross-sectional view across lines 2—2 of FIG. 1.

FIG. 2 shows a cross-sectional view of the device of FIG. 1. As can be seen, the case 12 extends around the core 14, the legs 24 and 26 and their associated secondary windings 16 and 18. Importantly, it can be seen in FIG. 2 that the first secondary winding 16 extends around a first secondary bobbin 28. Similarly, the second secondary winding 18 extends around a second secondary bobbin 30. A first primary winding 32 extends around a first primary bobbin 34 positioned over the leg 24. A second primary winding 36 extends over a second primary bobbin 38. The second primary bobbin 38 is placed over the second leg 26.

Importantly, in FIG. 2, it can be seen that the legs 24 and 26 are formed of laminated material. The particular arrangement of the laminated material causes each of the legs 24 and 26 to have a generally circular or round cross-sectional area. These approximately round legs simply allow the primary and secondary bobbins to be round without any wasted space within the case 12. For example, if a square leg was placed in a round bobbin, then space would be wasted. The generally circular cross-section of each of the legs 24 and 26 simply gives a smaller design with equal performance. The laminations used for the formation of the core 14 and the associated legs 24 and 26 are easily produced by progressive lamination stamping using computer controlled machines.

Figure 3:
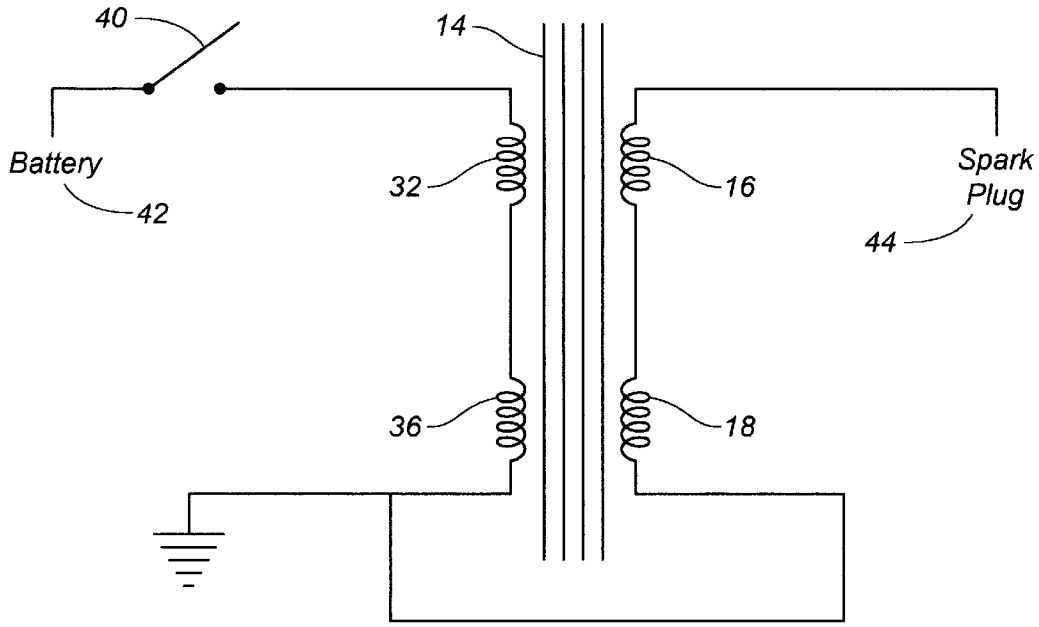
FIG. 3 is a schematic diagram showing the operation of the present invention.

FIG. 3 shows a schematic view of the system of the present invention. As can be seen in FIG. 3, the primary windings 32 and 36 are connected in series. A power source, such as a vehicle battery 42, is interconnected by switch 40 to the primary windings 32 and 36. The switch 40 can be in the nature of a controller which causes the switch 40 to selectively actuate and pass energy from the battery 42 to the primary windings 32 and 36. In the preferred embodiment of the present invention, the primary windings 32 and 36 are each wound as a single layer over the respective bobbins 34 and 38. Each of the primary windings 32 and 36 can have approximately 64 turns in a single layer of #23 gage magnet wire. The primary windings 32 and 36 are shown in a relative position to the core 14. Secondary windings 16 and 18 are connected in series. In the preferred embodiment of the present invention, the secondary windings 16 and 18 are progressively wound in multiple layers over their respective bobbins 28 and 30. Specifically, each of the first and second secondary windings 16 and 18 can have 5,000 turns of #42 gage magnet wire arranged in approximately twelve progressively wound layers. The transformer effect created by the circuit shown in FIG. 3 will cause a delivering of up to 60 millijoules of energy to the spark plug 44. Increasing or decreasing turns of primary and secondary can create various energies and secondary output voltages. Due to the close coupling of the primaries and secondaries, the energies are 25% to 30% greater than conventional coils.

It is important to note that the use of separate primary windings 32 and 36 connected in series and the use of separate secondary windings 16 and 18 connected in series allows a total secondary winding length of between two inches and three inches. This also allows the windings to be progressively wound. The "mean length of turn" of the primary and secondary windings is shorter. As such, less magnet wire is required in the design. Approximately 50% less magnet wire is required for the secondary winding. In contrast to the prior art, typical section bobbin coils contain approximately 0.1 pounds of small gage wire (0.0025 inches in diameter). In contrast, the design of the present invention contains 0.05 pounds of the same wire while delivering up to 60 millijoules of energy.

In the present invention, the electronic module, that can be connected to the housing 22 and is represented by switch 40 in FIG. 3, can contain a Darlington transistor or special transistor called an "IGBT". This serves the function of the switch 40. This replaces the breaker points of standard prior art ignition systems. The electronic module can also include a means for "clamping" the primary voltage so as to protect the IGBT and other components from over voltage. The controller can contain a circuit to shut down the power momentarily, if the peak primary current goes above the design level. Various other protection circuits could also be incorporated into the design of the controller electronics.

Figure 4:
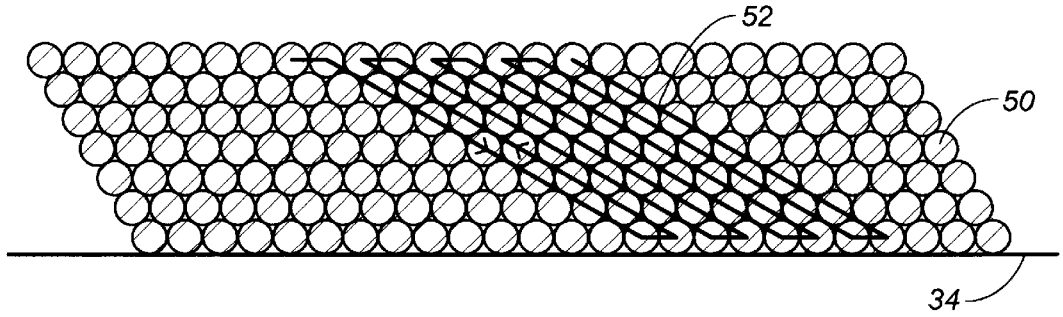
FIG. 4 is an end view illustrating a progressive winding of a coil.

FIG. 4 is a greatly magnified cross-sectional view showing the arrangement of the progressive wiring on the secondary bobbin 28. As can be seen, there are a total of six layers of wire 50 arranged on the bobbin 28 in a progressive manner. The goal of progressive winding is to reduce the voltage within or between layers, in particular, between the first turn of the layer and the last turn of the next layer. In progressive winding, the layers are placed at an angle or slope in a manner similar to creating a mountain with sand or by laying planks against a wall. The winding with progressive winding winds the wire at an angle. This is achieved through moving forward, returning in successive layers but with a certain progression for each forward and return layer. Progressive winding avoids the problems associated with multiple bays of winding bobbins. Also, as can be seen in FIG. 4, the height of the seven layers in FIG. 4 is less than the height would be if each of the wires were directly upon the top of an underlying layer of wire. The line pattern 52, as shown in FIG. 4, shows the manner of winding the wire 50 so as to achieve this progressive wiring effect.

Figure 5:
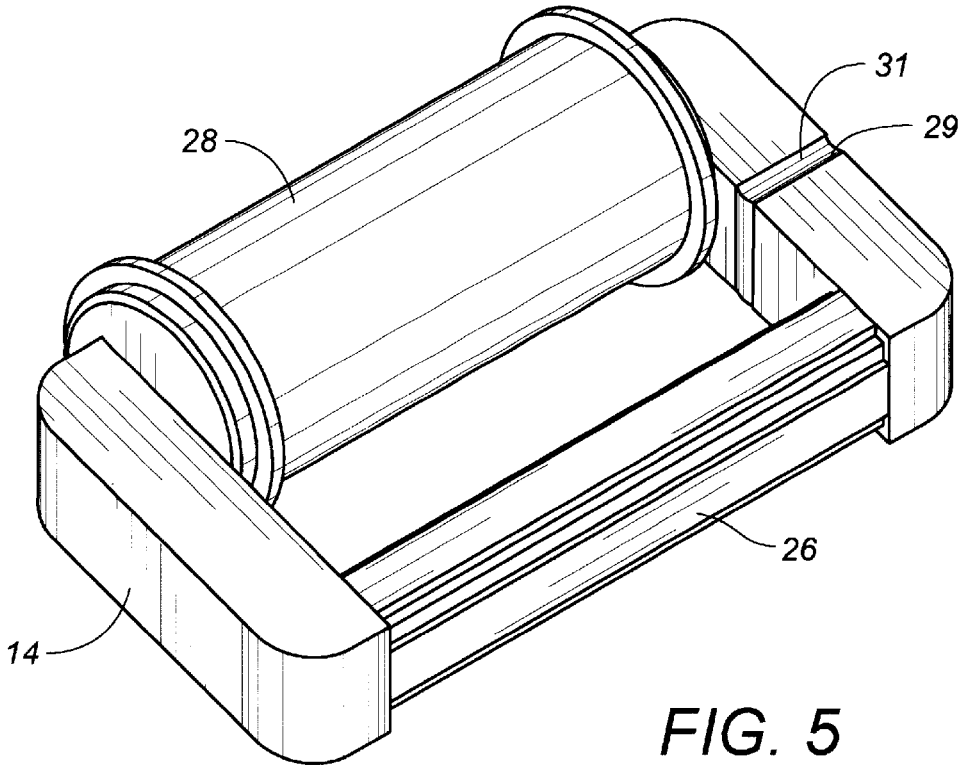
FIG. 5 is a perspective view showing the laminated core and the secondary bobbin of the ignition coil of the present invention.

FIG. 5 shows the core 14 with leg 26 exposed. It can be seen that leg 26 has a generally round cross-section formed by the laminated layers of steel. Secondary bobbin 28 (without the winding illustrated) is placed over the other leg 24 (not shown). Secondary bobbin 28 is a cylindrical bobbin which is flangeless in the area between the flanges at opposite ends of the bobbin. Such flangeless bobbins allow windings to occur faster without slowing to change bays. The use of the flangeless bobbin avoids the problem of wires hanging up on the flanges and not falling to the bottom of the bay. As such, defective coils can be avoided. The primary coil and associated bobbin are located interior of the secondary bobbin 28. The core 14 has an air gap 29 at one end. A magnet 31 is positioned in the air gap 29.

Figure 6:
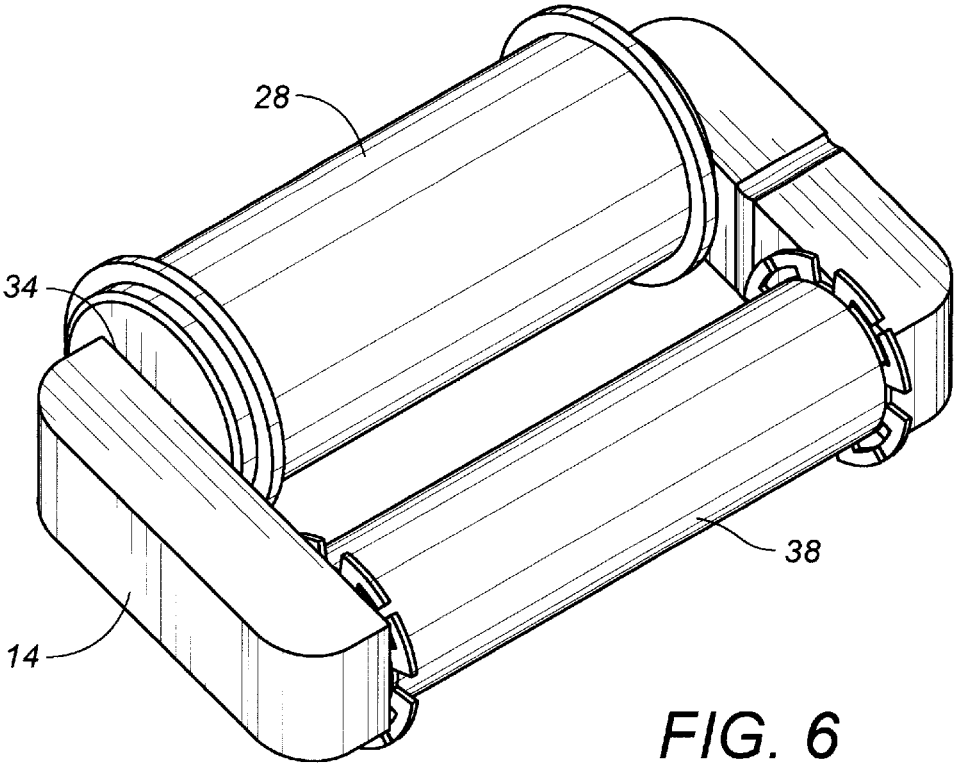
FIG. 6 is a perspective view showing the primary bobbin and the secondary bobbin as used on the ignition coil of the present invention.

FIG. 6 shows the core 14 with a second primary bobbin 38 placed over leg 26 and a secondary bobbin 28 placed over a primary bobbin 34 over leg 24. The second primary bobbin 38 is in close proximity to the leg 26 thereunder. A single layer of magnet wire is wound as one layer over the second primary bobbin 38.

Figure 7:
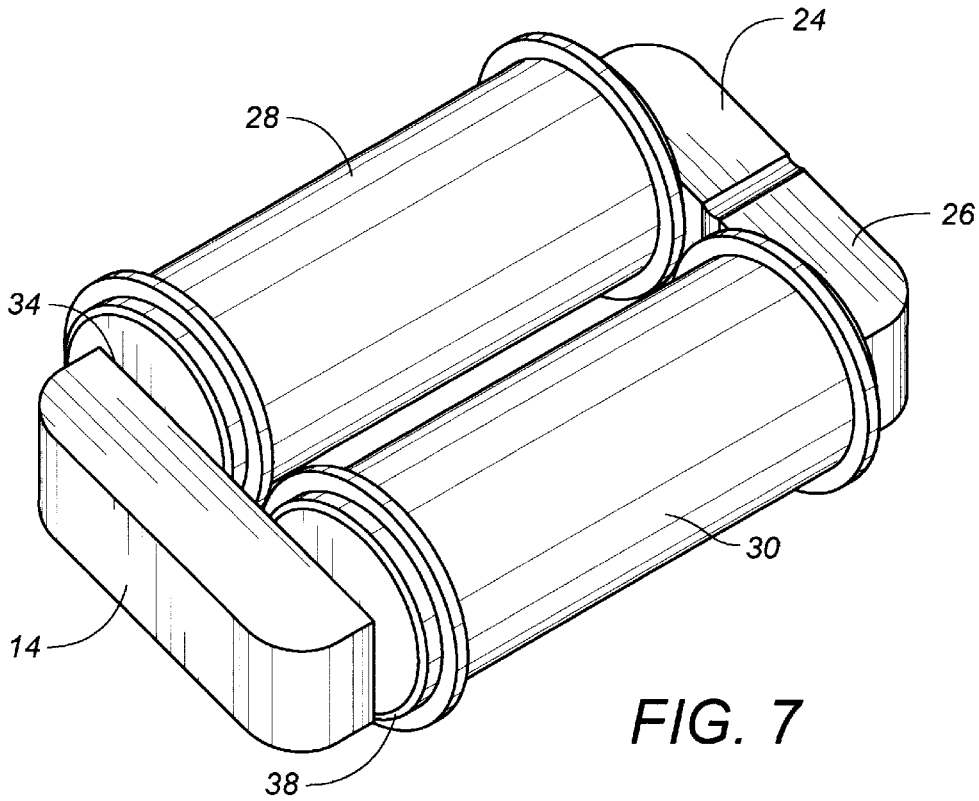
FIG. 7 is a perspective view showing the first and second secondary bobbin as applied over the core of the ignition coil of the present invention.

FIG. 7 shows the core 14 with the secondary bobbins 28 and 30 positioned over the respective legs 24 and 26. The respective primary bobbins 34 and 38 are located interior of the secondary bobbins 28 and 30. The secondary bobbins 28 and 30 will each receive approximately twelve layers of #42 (0.0028 inches in diameter) magnet wire. These twelve layers are wound in a progressive manner.

Figure 8:
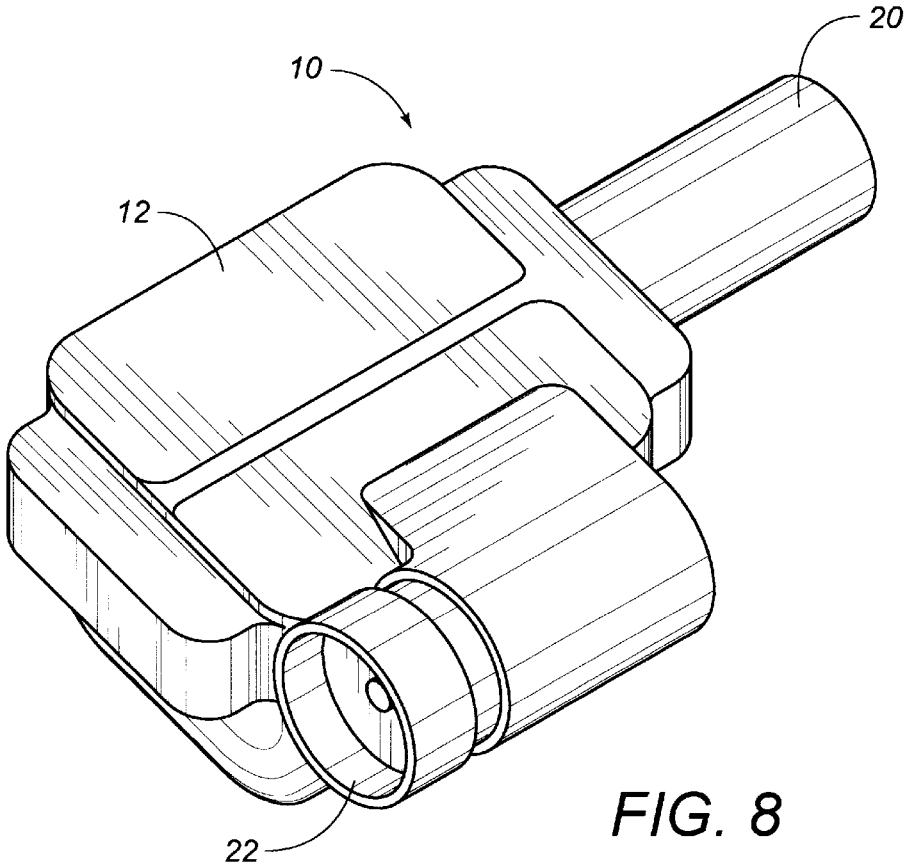
FIG. 8 is a perspective view showing the case of the ignition coil of the present invention.

FIG. 8 shows a case 12 which is formed so as to extend over the primary windings 32 and 36 and the secondary windings 16 and 18. The case 12 also extends over the core 14. In FIG. 8, the spark plug terminal opening 20 allows the attachment of the ignition coil 10 to a spark plug. An electronic module housing 22 is also provided so as to allow the ignition coil 10 to be connected to a suitable controller. As can be seen, the case 12 has a very low profile and a light weight (220 g). The windings within the case 12 are suitably potted so as to be retained in a secure position and impervious to normal vibration.

The electronic module, that would be connected to the ignition coil 10, will allow for the proper control of the output charge from the ignition coil 10. The electronic module has an electronic source trigger which is the signal input for the ignition coil 10. This electronic source trigger comes from the engine control module. The electronic source trigger "on" threshold should be less than or equal to 2.75 volts. The electronic source trigger "off" threshold should be greater than or equal to 1.3 volts. Hysteresis should be no less than 0.25 volts. Input impedance should be 10 Kohms plus or minus 10%. The electronic module must reference the electronic source trigger signal to the electronic source trigger low signal. The electronic module power ground should be isolated from the electronic source trigger low. The loss of the electronic source trigger low signal does not cause the electronic module to be inoperable.

The electronic module will have certain output characteristics. The electronic module will limit the ignition coil primary current to a maximum of 12 amps. The normal ignition coil primary current will be 8 amps and a primary voltage clamp of 400 to 600 volts. In the event that the electronic source trigger signal remains "on" until the current limit has been reached, the electronic module shall immediately begin ramping down the ignition coil primary current. The electronic module should be capable of operating at a temperature of between −40° C. to 150° C. The battery supply voltage should be between 4.5 volts to 16.0 volts.

In experiments with the present invention, a great deal of spark energy was obtained from a relatively small package. The test results are reproduced in Table 1 hereinbelow.

TABLE 1

| Battery Voltage (V) | Dwell (mS) | Primary Current (A) | Arc Duration (mS) | Secondary Current (mA) | Spark Energy (mJ) | KV/30 pF (KV) |
|---|---|---|---|---|---|---|
| 4.5 | 15.0 | 7.6 | 1.6 (>0.80) | 94 (75–125) | 54 (15) | 37.2 (23) |
| 6.0 | 7.3 | 8.0 | 1.7 (>0.80) | 95 (75–125) | 56 (20) | 37.2 (26) |
| 10.0 | 3.3 | 8.0 | 1.7 (>0.80) | 95 (75–125) | 56 (35) | 37.2 (32) |
| 14.0 | 2.3 | 8.0 | 1.7 (>0.80) | 97 (75–125) | 56 (40) | 37.5 (35) |

The present invention achieves many advantages over the prior art. The progressive winding reduces the voltage between layers. The round secondary bobbins allow constant tension over the very fine wire which is used for the secondary winding. The absence of flanges means that there are no loops, no cross-overs and constant speed winding. The use of #42 gage wire instead of #44 gage wire will result in less stretch and easier connections.

The use of a single layer of winding for the primary is very simple and easy to achieve. Since the laminations used for the formation of the iron core are covered with a polymeric material, rust is avoided. The use of the magnet in the air gap will allow for the creation of a much smaller and lighter ignition coil. Since the laminations are covered with PBT polymer, the use of glass-filled epoxy is not required.

The foregoing disclosure and description of the invention is illustrative and explanatory thereof Various changes in the details of the illustrated construction may be made within the scope of the appended claims without departing from the true spirit of the invention. The present invention should only be limited by the following claims and their legal equivalents.

I claim:

1. An ignition system for a vehicle comprising:

a power supply;

a spark plug; and an ignition coil electrically connected to said power supply and electrically connected to said spark plug, said ignition coil comprising:

a core having a first leg and a second leg;

a first primary winding arranged over said first leg;

a second primary winding arranged over said second leg, said first primary winding connected in series to said second primary winding;

a first secondary winding arranged over said first primary winding; and a second secondary winding arranged over said second primary winding, said first secondary winding connected in series to said second secondary winding, said first and second primary windings being electrically interconnected to said power supply, said second secondary winding being electrically connected to said spark plug.

2. The system of claim 1, further comprising:

a control means electrically connected to said first and second primary windings and to said power supply, said control means for selectively passing a voltage from said power supply to said first and second primary windings.

3. The system of claim 1, said first and second leg of said core being arranged in generally parallel relationship, said first and second legs having an air gap therebetween, said air gap having a magnet positioned therein between said first and second legs.

4. The system of claim 1, said core being of a laminated steel construction, each of said legs having a generally circular cross-section.

5. The system of claim 1, said first primary winding being wound around a first primary bobbin, said first primary bobbin positioned directly over and adjacent to said first leg, said second primary winding being wound around a second primary bobbin, said second primary bobbin positioned directly over and adjacent to said second leg.

6. The system of claim 1, said first second winding being progressively wound in multiple layers over a first secondary bobbin, said first secondary bobbin positioned directly over said first primary winding, said second secondary winding being progressively wound in multiple layers over a second secondary bobbin, said second secondary bobbin positioned directly over said second primary winding.

7. The system of claim 6, said first and second secondary bobbins being flangeless between flanges at opposite ends thereof.

8. The system of claim 1, said power supply being a battery having a capacity of between 4.5 and 14 volts, each of said first and second primary windings being approximately sixty-four turns in a single layer of #23 gage magnet wire, each of said first and second secondary windings being of approximately 5,000 turns of #42 gage magnet wire arranged in approximately twelve progressively wound layers.

9. The system of claim 1, further comprising:

a case receiving said core and said first and second primary windings and said first and second secondary windings in potted relationship therein, said case having a spark plug terminal opening at a surface thereof, said spark plug having a terminal directly connected within said spark plug terminal opening.

10. An ignition coil comprising:

a core having a first leg and a second leg;

a first primary winding arranged over said first leg;

a second primary winding arranged over said second leg, said first primary winding connected in series to said second primary winding;

a first secondary winding arranged over said first primary winding;

a second secondary winding arranged over said second primary winding, said first secondary winding connected in series to said second secondary winding; and a spark plug terminal electrically connected to one end of said second secondary winding.

11. The ignition coil of claim 10, said first and second legs of said core arranged in generally parallel relationship.

12. The ignition coil of claim 11, said first and second legs having an air gap therebetween, said air gap having a magnet positioned therein between said first and second legs.

13. The ignition coil of claim 10, said core being of laminated silicon steel construction, each of said first and second legs having a non-square cross-section.

14. The ignition coil of claim 13, each of said legs having a generally circular cross-section.

15. The ignition coil of claim 10, said first primary winding being wound around a first primary bobbin, said first primary bobbin positioned directly over and adjacent to said first leg, said second primary winding being wound around a second primary bobbin, said second primary bobbin positioned directly over and adjacent to said second leg.

16. The ignition coil of claim 15, said first primary winding being wound as a single layer of said first primary bobbin, said second primary winding being wound as a single layer over said second primary bobbin.

17. The ignition coil of claim 10, said first secondary winding being progressively wound in multiple layers over a first secondary bobbin, said first secondary bobbin positioned directly over said first primary winding, said second secondary winding being progressively wound in multiple layers over a second secondary bobbin, said second secondary bobbin positioned directly over said second primary winding.

18. The ignition coil of claim 17, said first and second secondary bobbins being flangeless between flanges at opposite ends thereof.

19. The ignition coil of claim 10, each of said first and second primary windings being approximately 64 turns in a single layer of #23 gage magnet wire, each of said first and second secondary windings being of approximately 5,000 turns of #42 gage magnet wire arranged in approximately twelve progressively wound layers.

20. The ignition coil of claim 10, further comprising:

a control means electrically connected to said first and second primary windings, said control means for selectively passing a voltage from a power supply to said first and second primary windings.

21. The ignition coil of claim 10, further comprising:

a case receiving said core and said first and second primary windings and said first and second secondary windings in potted relationship therein, said spark plug terminal opening at a surface of said case, said case having an opening accessing a terminal for said first and second primary windings such that said first and second primary windings can be connected to a power supply.

* * * * *